United States Patent [19]

Rahner

[11] Patent Number: 5,007,253

[45] Date of Patent: Apr. 16, 1991

[54] PORTABLE LACE CLIPPING AND SHEARING APPARATUS FOR SYNCHRONOUS OPERATION WITH A LACE-KNITTING MACHINE

[76] Inventor: Thomas Rahner, 1126 17th Ave., West Belmar, N.J. 07719

[21] Appl. No.: 306,947

[22] Filed: Feb. 6, 1989

Related U.S. Application Data

[63] Continuation-in-part of Ser. No. 173,079, Mar. 25, 1988, abandoned.

[51] Int. Cl.[5] ..... D04B 35/00

[52] U.S. Cl. ..... 66/149 R; 66/147

[58] Field of Search ..... 66/147; 26/15

[56] References Cited

U.S. PATENT DOCUMENTS

| | | | |
|---|---|---|---|
| 1,532,989 | 4/1925 | Gordier | 26/12 |
| 3,105,284 | 10/1963 | Krug | 26/12 X |
| 3,327,366 | 6/1967 | Holm | 26/15 R |
| 3,390,603 | 7/1968 | Graichen | 139/291 X |
| 3,727,433 | 4/1973 | Hamano | 66/147 |
| 4,551,995 | 11/1985 | Louison | 66/147 |

FOREIGN PATENT DOCUMENTS

| | | | |
|---|---|---|---|
| 226351 | 3/1963 | Austria | 66/149 R |
| 63121 | 1/1941 | Norway | 66/149 R |
| 2019162 | 10/1979 | United Kingdom | 66/149 R |

*Primary Examiner*—Wm. Carter Reynolds

*Attorney, Agent, or Firm*—Ostrolenk, Faber, Gerb & Soffen

[57] ABSTRACT

A portable clipping and shearing apparatus for clipping and shearing float from lace sheet. The apparatus is mechanically coupled to the lace-knitting machine and is adapted to take up the sheet directly as it emerges from the lace-knitting machine to clip and shear the float forthwith. Consequently, trimmed lace sheet flows out of the portable device of the present invention, avoiding costly multiple handling of the lace sheet. The portable clipping and shearing apparatus is provided with a synchronization mechanism that synchronizes its processing speed to that of the lace-knitting machine. As the portable shearing and clipping apparatus is adapted for the relatively slow lace making machine, the device of the present ivnention is small enough to be easily transported to the location of a warp knitting machine, simple in construction, and more commonly affordable.

10 Claims, 3 Drawing Sheets

PORTABLE LACE CLIPPING AND SHEARING APPARATUS FOR SYNCHRONOUS OPERATION WITH A LACE-KNITTING MACHINE

BACKGROUND OF THE INVENTION

The present invention is a continuation-in-part of application Ser. No. 07/173,079, filed March 25, 1988, now abandoned.

The present invention is related to a clipping and shearing machine for removing from bobbinet and similar fabric such as lace, the loose threads, called "clips" or "floats", which bridge the lace's motives (designs) to one another.

In the lace making art, warp knitting machines are employed to form repeating patterns of lace designs in a web-like fabric which is knitted simultaneously as motif. The knitted fabric which features the lace thereon emerges from the machine in certain standard widths and is rolled up on a roll. The final lace pattern consists of discreet, unconnected motives (flowers or other adornments). However, because it is most practical to use continuous thread in the lace knitting process, the lace emerges with the discreet motives connected by loose bobbin threads which connect the motives to one another and which must be removed from the fabric.

Conventional wisdom in the art of lace making has been to process the clip lace, after it emerges from the lace making machine, in special, very high speed and expensive clipping and shearing machines which first cut each connecting thread into two strands which are thereafter sheared from the material close to the motives.

The lace making process is relatively slow and the myriad of possible patterns and applications has spawned numerous specialty lace making shops. An average lace mill may have 20 to 30 lace making machines and typically may run one third to one half of the machines on clip lace patterns, depending on market demand, as well as the type of machines in the shop. Accordingly, it has been customary for small lace making shop owners to subcontract the clipping and shearing aspect of their work to specialty houses which can justify the large investment in the high-speed shearing and clipping machines.

The present industry practice has resulted in a bottleneck wherein the small operators must postpone final delivery of their product pending the routing of their work product through the clipping and shearing processors. These small specialty shops cannot justify the large investment in the high-speed shearing and clipping machines.

Clipping and shearing machines for handling lace are old. For example, U.S. Pat. No. 361,563 dating back to 1887 discloses a machine for clipping lace, i.e. cutting each float into two strands. Machines for shearing the loose threads or strands created by the clipping operation are described for example in U.S. Pat. No. 2,747,534 to Piper et al. and U.S. Pat. No. 3,327,366 to Holm.

PREVIOUS ART

Other machines have attempted to deal with clipping lace patterns by attaching clipping and shearing apparatus to lace machines but all the prior art dealing with apparatus attached to the lace machine share one major fault, namely, complexity of design, installation and operation which severely limits the practical application of such machinery. Because of their complex design these apparatus must be assembled and permanently or semipermanently mounted to a lace machine to create an operable relationship between themselves, the lace sheet and the lace machine. These fixed machines are also cumbersome and make repairs of damages on the lace sheet awkward, as well as repairs to lace machines. Furthermore, the previous art, because of its fixed attached nature, does not allow for flexibility in moving of a clipping and shearing apparatus from one lace machine to another. The importance of this flexibility is paramount to the novelty of this invention.

Because frequent pattern changes are made on lace machines according to market demand, a mill operator cannot always pick which machine a clip lace pattern will go on. Under the present scope of the prior art this leaves the mill operator with two poor choices. Firstly, he can disassemble and reassemble an apparatus on a lace machine each time a new clip pattern needs it. This would result in 24 to 72 hours downtime and extensive labor costs. Secondly, he can outfit his entire mill of lace machines with the fixed apparatus resulting in excessively impractical outlay of capital.

SUMMARY OF THE INVENTION

Accordingly, it is an object of the present invention to provide a simpler clipping and shearing machine having the attribute of being more commonly affordable.

It is another object of the present invention to provide a portable, self contained clipping and shearing apparatus allowing flexibility of movement from one machine to another.

It is a third object of the present invention to provide a clipping and shearing apparatus which can be quickly and easily attached and synchronized with a lace machine.

It is a further object of the present invention to provide a self contained clipping and shearing apparatus which will provide easier access when repairing damages on the lace cloth while it is still on the lace machine.

It is another object of the clipping and shearing machine to be powered by the lace machine through two chains connecting the take up mechanism and the clipping and shearing mechanisms to the take up roller and the main shaft of the lace machine.

In realization of the foregoing and other objects, the present invention provides a portable clipping and shearing machine for finishing lace sheets produced by a lace machine. A take up roller, in the portable machine, receives the lace sheet as it emerges from the lace machine and directs it to a clipping mechanism at which time each float on the lace sheet is cut into two dangling strands.

The lace sheet then travels to a shearing mechanism which shears the strands off the lace sheet, close to the surface of the motives from which the strands dangle. To enable the portable clipping and shearing machine to operate in tandem with the lace knitting machine, the lace sheet processing speed of the clipping and shearing machine is synchronized to the speed at which the lace sheet emerges from the lace machine.

Other features and advantages of the present invention will become apparent from the following description of preferred embodiments thereof which are presented below in relation to the appended drawings.

DETAILED DESCRIPTION OF PREFERRED EMBODIMENTS

Figure 1:
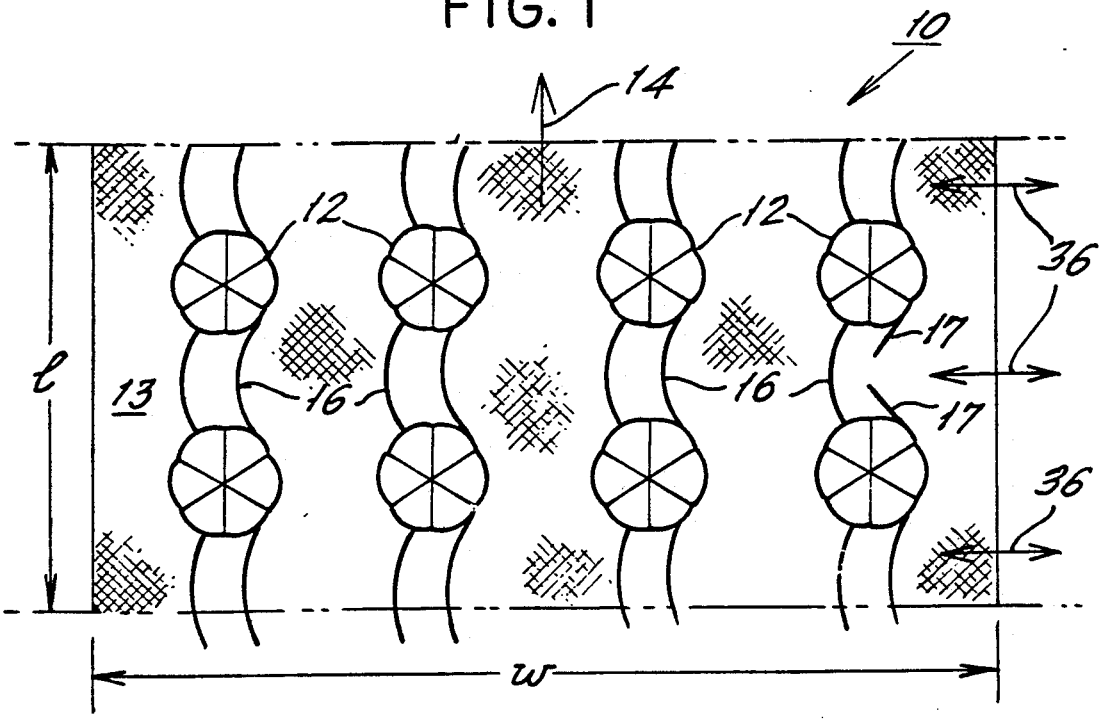
FIG. 1 depicts a section of lace having a plurality of motives interconnected by floats.

Referring to the drawings, FIG. 1 illustrates a swatch of lace 10 comprising a plurality of discreet lace insertions 12. Each one of the discreet lace insertions 12 defines a pattern such as a flower, a star or the like, each pattern being referred to in this art as a "motif" or "motives" in the plural.

To knit lace on a warp knitting machine, in a width which is determined by the particular pattern's mechanical set out and usually approximately 130 inches, the fine threads from main beam warps are knitted into loops which are patterned to form the basic fabric. As these loops are formed, the pattern threads from spot beams are "laid-in" to the loops to form predetermined designs or motives.

The linear speed of the knitted lace is slow, approximately 3 to 6 inches per minute, even though the loops are formed at a rate between 300–400 per minute, depending on a main drive shaft's RPM which corresponds at a 1:1 ratio to loop forming. (There are approximately 40–60 loops per inch, depending on, the pattern. In some machines, the linear speed of the knitted lace is about 4–7 inches per minute.

All threads must be continuous in this knitting process. Therefore, each motif is connected to adjacent motives by the floating motif (pattern) ends. This excess thread must be removed from the finished lace product by trimming each float at both ends close to the motives to which it is connected. Customarily, lace sheet 10 which emerges from the knitting machine, is rolled up and sent out to be trimmed.

In accordance with the present invention, the lace sheet undergoes a post processing step involving feeding the lace first through a clipping machine to cut each float 16 into two floating strands 17 as shown at the right hand side of FIG. 1. In a second step, a shearing device shears strands 17 from lace sheet 10 close to motives 12.

Figure 3:
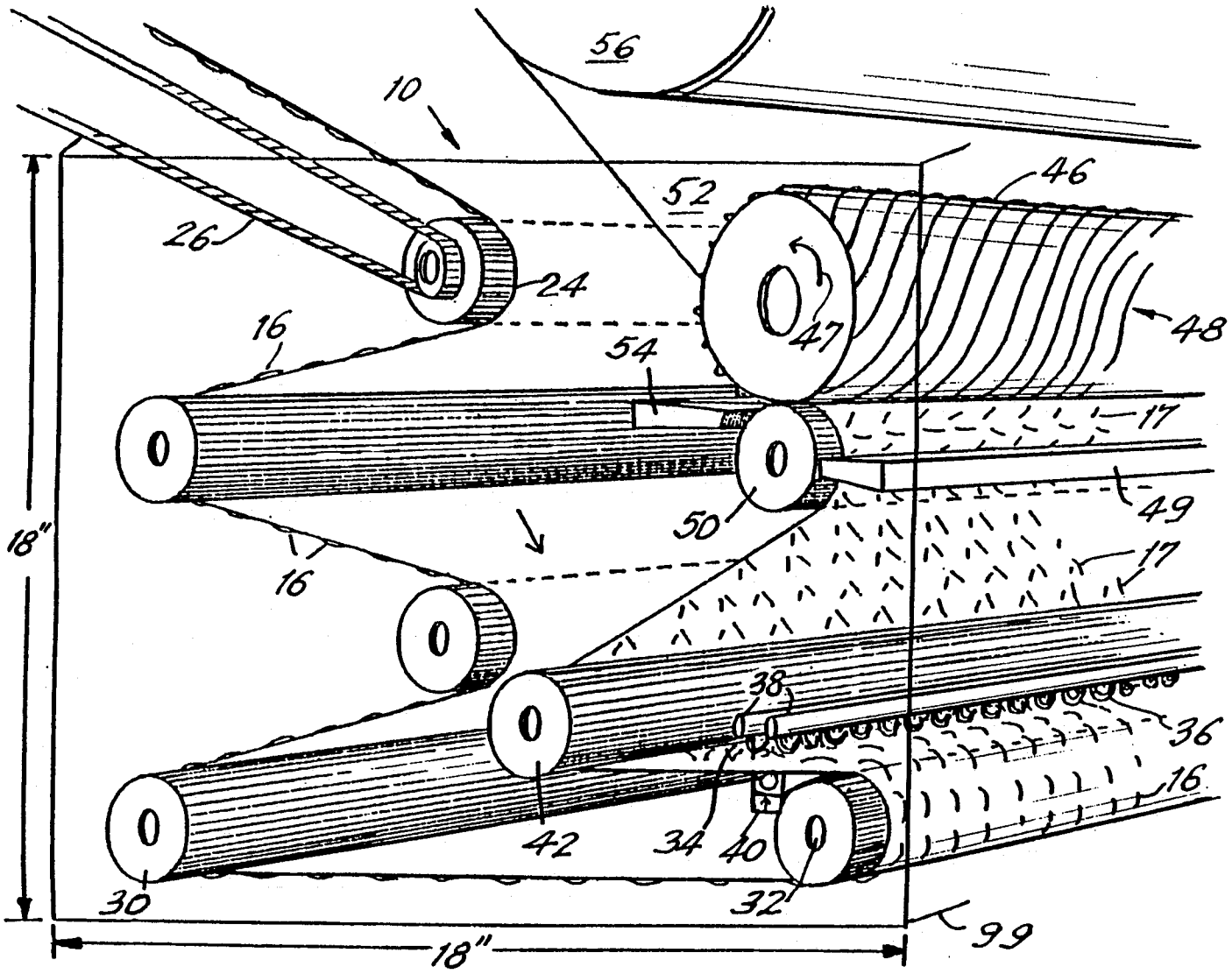
FIG. 3 shows the cutting blades of the clipping section of the machine shown in FIG. 3.

FIG. 3 illustrates a preferred embodiment of a self contained, wheelable and thus portable clipping and shearing machine 18 which includes a housing 99 and in the housing 99 a take up roller 24 for taking up lace sheet 10 directly from knitting machine 20. Take up roller 24 is rotated by chain 26, which is driven by power derived from a low speed shaft (not shown) of knitting machine 20. Chain 26 is designed to rotate take up roller 24 at that speed which will cause lace sheet 10 to be fed into clipping and shearing machine 18 at the speed at which the sheet 10 is dispensed from knitting machine 20. It is feasible, however, to construct chain 26 as a tensioning mechanism, for example, as an independently driven motor (not shown) and a suitable control circuit for enabling rotator 26 to rotate roller 24 at a speed that will result in the taking up of lace sheet 10 at the speed at which it is supplied from knitting machine 20.

Next, lace sheet 10 passes through an arrangement of direction and tension rollers 30, which readjust the tension on lace sheet 10 and orient floats 16 as shown.

Figure 2:
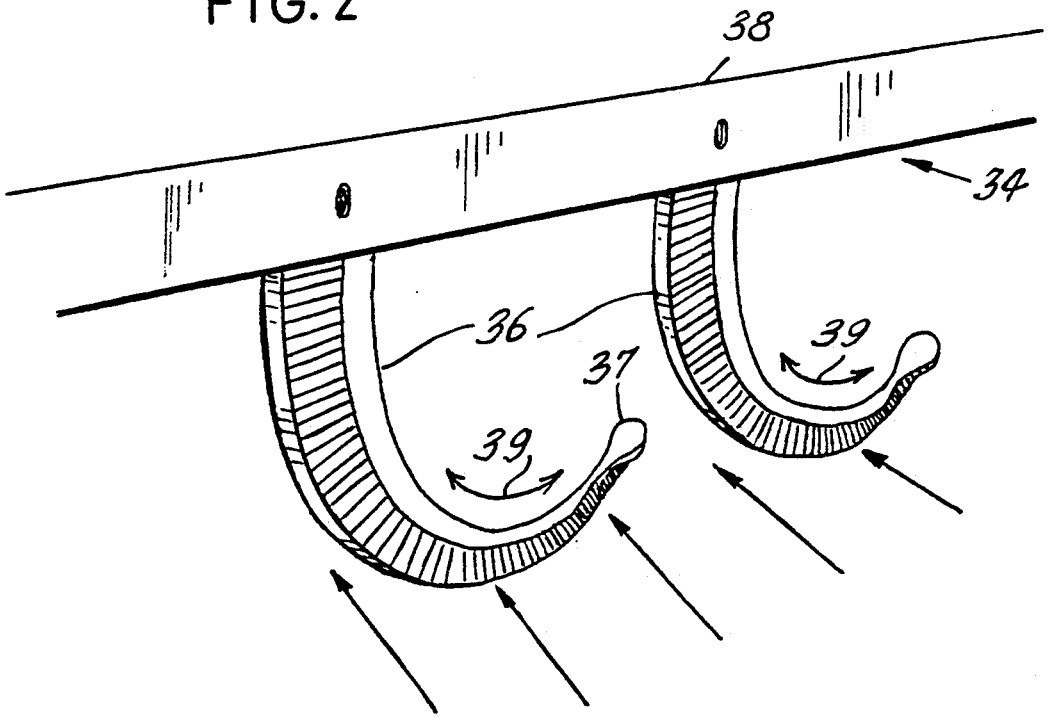
FIG. 2 illustrates, perspectively, a preferred embodiment of a portable and synchronized shearing and clipping apparatus in accordance with the present invention.

A first redirection roller 32 changes the orientation of lace sheet 10 such that floats 16 face up and toward clipping apparatus 34. Clipping, apparatus 34 comprises, as shown for example in FIG. 2, a plurality of, sickle-shaped, cutting blades 36 which are supported on bar 38 and are cam-driven to oscillate perpendicularly to the direction of travel of lace sheet 10, in the directions of arrows 39 such that the blades will lift and cut yarn floats 16. Cutting blades 36 span the entire width of lace sheet 10 over a distance of about 130 inches, which is typical of lace sheets. Each cutting blade 36 has a spoon-tip shaped end 37 that serves to slice float 16 during a forward oscillation (to the right in FIG. 4). Thus, each float 16 is transformed into two floating strands 17.

Tension level adjustor 40 is disposed beneath lace sheet 10, directly below clipping apparatus 34, to adjust the spacing between lace 10 and cutting blades 36 to assure that all the yarn floats 16 are snagged and cut by the cutting blades of the clipping apparatus.

Secondary direction roller 42 is disposed past clipping apparatus 34 and serves to orient strands 17 to face downwardly in a position that enables the strands 17 to flip upwardly just as they are engaged by shearing blades 46 of shearing apparatus 48.

Shearing apparatus 48 comprises a bottom platen 50 and a top roller 52 which supports shearing blades 46. The shearing blades 46 project radially from the roller 52, spiraling about the axis of rotation of the roller 52. As top roller 52 rotates in the direction of arrow 47, strands 17 are sheared and collected in waste bin 49. Generally, shearing apparatus 48 is of the type illustrated in Holm's U.S. Pat. No. 3,327,366 which is described in the background section of the present specification, the contents of which are incorporated by reference herein. Adjustable ledge 54 controls the position of lace sheet 10 relative to shearing blades 46 and determines how close strands 17 will be trimmed relative to motives 12.

After emerging from shearing apparatus 48, lace sheet 10 is rolled up into a roll 56 on a roller (not shown) and is ready for dyeing, cutting or other operations. In a preferred embodiment, the aforementioned roller is comprised of the take up roller of the knitting machine 20. In this case, lace sheet 10 is typically diverted temporarily to clipping and shearing apparatus 18 for being clipped and sheared. It is, however, returned to knitting machine 20 to be rolled up on the take up roller which is part of the knitting machine 20.

Shearing apparatus 48 and clipping apparatus 34 are driven solely from knitting machine 20. In this case, shearing apparatus 48 is coupled to a high speed shaft (not shown) of knitting machine 20, via line 28. Conventional gear boxes are included to drive the shearing apparatus 48 at a speed which is suitable for carrying out the clipping and shearing functions. The shearing apparatus 48 and clipping apparatus 34 may be driven by power derived from other sources of high rotational speed, for example, an independent motor (not shown) or the like. But this is not preferred.

Figure 4:
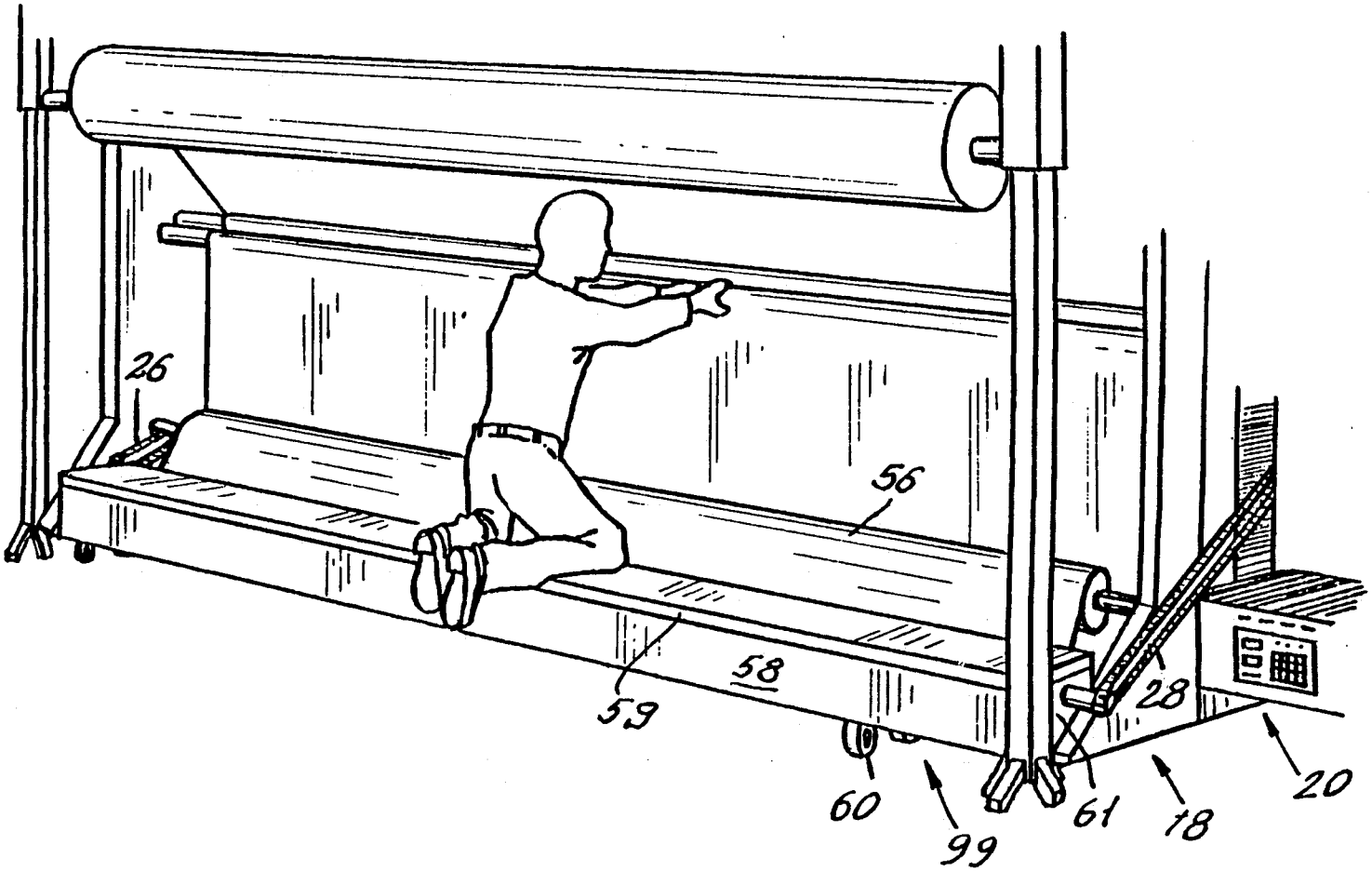
FIG. 4 shows the enclosed, self contained clipping and shearing apparatus in relationship to a lace machine and a worker fixing a damage on the lace.

FIG. 4 illustrates the mechanisms illustrated in FIG. 3 but supported by a housing 99 and enclosed by a metal shell 58 and positioned by lace machine 20. The self contained apparatus 18 illustrated in FIG. 4 will have an approximate height of 18–24 inches, a similar width and a length which is at least as long as the width of the lace sheet 10, typically about 130 inches. The metal shell 58 is at an approximate height 50 inches so as not to block the view of lace 10 as it moves off the lace machine 20 but allowing a worker to comfortably kneel on top of it to repair damages on lace sheet 10.

Metal shell 58 has a hinged top 59 and similar sides to allow full view of clipping and shearing operation as well as access for repairs or replacement of clipping or shearing knives.

The enclosed self contained shell 58 has lockable casters 60 underneath to allow for easy wheeling thereof by two people since its overall weight is approximately 200 lbs. Also because of their light weight, several of the apparatuses of the present invention which might not be needed at some point can be stacked on top of one another.

FIG. 4 also shows the simple manner in which the chain connections 26 and 28 which drive the take up rollers 30 and the clipping and shearing apparatus of FIG. 3 are coupled to the lace machine 20. These chain connections 26 and 28 link the clipping and shearing apparatus to the high speed main cam shaft (not shown) of the knitting machine 20 through a gear box 61 on the side of the cutting shears.

On the left side of the FIG. 4 apparatus there is the chain 26 which connects the take up rollers of the lace machine (not shown) to the take up rollers of the portable clipping and shearing apparatus. This provides exact continuity of the lace sheet movement from the lace machine through the portable clipping and shearing apparatus.

Furthermore, besides the ease of moving this portable clipping and shearing apparatus from one machine to another it can be connected and made operable on a machine with a new clip lace pattern in approximately two hours time. This is so because it is self contained and easily synchronized by means of the two chain connections 26 and 28 and through adjustment, if needed, of the gear box 61 tension level adjustor 40 and the adjustable ledge 54.

The present invention therefore makes the task of coupling a shearing and clipping apparatus to a knitting machine exceedingly simple. All that is needed is to wheel the apparatus 18 adjacent the lace machine 20 and to couple thereto the chain 28 and/or the chain 26. If needed, the gear box 61, the tension level adjustor 40 and the adjustable ledge 54 are adjusted as well. With this simple procedure, the system is readied for operation. The key to the invention is that no part of the clipping and shearing apparatus 18 need be connected either permanently or semipermanently, as by bolts or the like, to the lace machine 20.

Although the present invention has been described above in relation to specific embodiments thereof, many other variations and modifications will now become apparent to those skilled in the art. It is therefore preferred that the present invention be limited not by the specific embodiments disclosed herein but only by the appended claims.

What is claimed is:

1. A portable and wheelable clipping and shearing machine for finishing lace sheet produced by a lace machine, said portable machine comprising:

a housing and a plurality of wheel means mounted to the housing for supporting the housing and enabling the housing to be wheeled to a location adjacent a lace machine;

a take up roller, supported by the housing, for taking up lace sheet as it emerges from said lace machine and a conveying means for conveying lace sheet through said clipping and shearing machine along a predetermined path;

clipping means, supported by the housing, for clipping floats disposed on said lace sheet to cut said floats into strands, each one of said strands being connected at one end thereof to a respective motif located on said lace sheet;

shearing means, supported by the housing, for shearing said strands from said lace sheet close to said respective motives; and coupling and synchronizing means for detachably coupling said portable machine to the lace machine in a manner enabling said portable machine to be driven from said lace machine and in a manner wherein the speed of movement of said lace sheet through said portable machine is synchronized to the speed at which said lace sheet emerges from said lace machine, said coupling and synchronizing means comprising the sole mechanical linkage between said portable machine and said lace machine whereby said machines may be easily and rapidly disattached and attached from and to one another.

2. A portable clipping and shearing machine as in claim 1, further comprising a tensioning mechanism for adjusting the tension of the lace sheet.

3. A portable clipping and shearing machine as in claim 2, wherein said clipping means comprises a plurality of cutting blades arranged in a row extending transversely to the predetermined path of said lace sheet, each one of said cutting blades being adapted to oscillate back and forth transversely to said path of said lace sheet and having a front edge which is shaped to snag said floats disposed on said lace sheet as said cutting blades oscillate in a forward direction.

4. A portable clipping and shearing apparatus as in claim 3, wherein said clipping means comprises a tension rod juxtaposed to said cutting blades and disposed on an opposite side of said lace sheet relative to said cutting blades, said tension rod being adapted to control the proximity of said cutting blades to said lace sheet.

5. A portable clipping and shearing machine as in claim 4, wherein the front edge is spoon-tip shaped.

6. A portable clipping and shearing apparatus as in claim 1, wherein said shearing means comprises a cylindrical roller and a plurality of shearing blades projecting radially from said cylindrical roller, each one of said shearing blades spiraling about an axis of said roller, said axis of said roller being disposed transversely to said path of said lace sheet.

7. A portable clipping and shearing apparatus as in claim 6, further comprising an adjustable ledge located below said lace sheet relative to said shearing blades for adjusting the distance between a side of said lace sheet containing said strands and said shearing blades of said shearing means.

8. A portable clipping and shearing apparatus as in claim 7, further comprising a waste bin for collecting said strands as said strands are sheared by said shearing means.

9. A portable clipping and shearing apparatus as in claim 8, wherein said lace sheet travels through said apparatus at a rate of about 4–7 inches per minute.

10. A portable clipping and shearing apparatus as in claim 2, wherein said lace sheet travels through said apparatus at a rate of about 3–6 inches per minute.

* * * * *